United States Patent [19]

Vogel

[11] Patent Number: 4,565,649

[45] Date of Patent: Jan. 21, 1986

[54] GRAPHITE INTERCALATION COMPOUNDS

[75] Inventor: F. Lincoln Vogel, Whitehouse Station, N.J.

[73] Assignee: Intercal Company, Port Huron, Mich.

[21] Appl. No.: 635,940

[22] Filed: Jul. 30, 1984

Related U.S. Application Data

[63] Continuation of Ser. No. 206,647, Nov. 13, 1980, abandoned, which is a continuation-in-part of Ser. No. 499,834, Aug. 23, 1974, abandoned.

[51] Int. Cl.[4] ..... H01B 1/04

[52] U.S. Cl. ..... 252/503; 252/506; 252/507; 423/445; 423/447.1; 423/447.2; 423/448; 423/460

[58] Field of Search ..... 252/503, 506, 507; 260/429 R; 423/445, 447.1, 447.2, 448, 460

[56] References Cited

U.S. PATENT DOCUMENTS 3,984,352 10/1976 Rodewald ..... 252/441
4,293,450 10/1981 Vogel ..... 252/503

*Primary Examiner*—Paul Lieberman
*Assistant Examiner*—Robert A. Wax
*Attorney, Agent, or Firm*—Kenyon & Kenyon

[57] ABSTRACT

An electrically conductive composition is disclosed which comprises a graphite intercalation compound of graphite, a Bronsted acid such as hydrogen fluoride, chloride, or bromide, nitric, nitrous, sulfuric or perchloric acid, and a metal halide selected from boron trihalide, a pentahalide of a metal from Group V of the Periodic Table, a tetrahalide of a metal from Group IV of the Periodic Table and mixtures thereof.

17 Claims, No Drawings

GRAPHITE INTERCALATION COMPOUNDS

CROSS-REFERENCE TO RELATED APPLICATIONS

This is a continuation of application Ser. No. 206,647 filed Nov. 13, 1980; which in turn is a continuation-in-part of application Ser. No. 499,834 filed Aug. 23, 1974, both now abandoned.

BACKGROUND OF THE INVENTION

The present invention relates to a highly electronically conductive composition which is graphite-based. More particularly, it relates to a graphite intercalation compound which is capable of conductivities approximating and even exceeding those attributed to pure copper.

Its utilities are widespread and many practical applications of the present compositions will be readily apparent to those skilled in the art. Foremost among these are formation of filaments of the composition for use as electrically conductive wires. In addition, the nature of the composition readily enables it to be formed into strips for use as bus bars in electrical equipment. The composition may also be formed into a metal composite and can hence be soldered or wrapped. Such composites are also useful in situations where physical strength is required in addition to high conductivity.

It has long been known that the unique crystalline structure of graphite makes it anisotropic with respect to conducting electrons. Its structure basically comprises planes of aromatically bound carbon atoms. Hence, each of such planes has $\pi$ clouds of electrons above and below it. These electron clouds have been said to contribute to its anisotropic conductive behavior, the conductivity being in a direction parallel to the aromatic carbon planes. This conductivity is approximately 5% that of copper.

Prior to the present invention, it was known that certain elements or molecules, when diffused into the graphite lattice, assume positions interstitial to the aromatic planes and improve graphite conductivity. Ubbeholde, for example, found that the interstitial compound formed between graphite and the Bronsted acid, nitric acid, has a conductivity almost equal to that of copper ($0.6\times10^6$ ohms $cm^{-1}$) when measured parallel to the aromatic planes (A. R. Ubbeholde, Proc. Roy. Soc., A304, 25 1968).

U.S. Pat. No. 3,409,563 granted to F. Olstowski describes conductive graphite structures formulated from vermicular graphite and bromine, sulfur trioxide, and certain metal chlorides. The treated vermicular graphite is then compressed into high density structures.

The present invention differs markedly from previous graphite intercalation compounds in many respects. Unlike the Ubbeholde compound, it is not solely derived from nitric acid and has a greatly increased conductivity over the Ubbeholde material. Nor is the present invention necessarily made from graphite which has been exfoliated at high temperatures as described by Olstowski.

SUMMARY OF THE INVENTION

These and other advantages are achieved by the present invention which is an electrically conductive, graphite intercalation compound. This compound is a composition of graphite, a Bronsted acid selected from hydrogen fluoride, hydrogen chloride, hydrogen bromide, nitric acid, nitrous acid, sulfuric acid or perchloric acid and a metal halide selected from boron trihalide, a tetrahalide of a Group IV metal of the Periodic Table or a pentahalide of a Group V metal of the Periodic Table. This composition is preferably in the form of a filament, but has many other embodiments and may be shaped into bars and/or formed into a metal composite. Preferred compositions include those of graphite, hydrogen fluoride or nitric acid and a metal halide. Especially preferred compositions include those of graphite, hydrogen fluoride and a metal halide.

DETAILED DESCRIPTION OF THE INVENTION

The metal halides of Group IV and V metals of the Periodic Table are of those metals which are tabulated under the headings IV A, IV B, V A and V B of the "Periodic Chart of the Elements" published in *The Condensed Chemical Dictionary,* Seventh Edition, facing p. 1, Reinhold (1966). In addition to these, it has been found that boron trihalides, especially boron trifluoride ($BF_3$), are useful. It has been found preferably to use $BF_3$, $SiF_4$, $HfF_4$, $TiF_4$, $ZrF_4$, $PF_5$, $NbF_5$, $TaF_5$, $AsF_5$ and $SbF_5$. Mixtures of these and other metal polyhalides are also within the scope of the present invention.

When the intercalation compounds are desired to be in filament form, it is preferable to incorporate them into a metal composite. This is to improve physical properties other than conductivity. For instance, a metal composite enables both mechanical and soldered electrical connections to be made, as well as permitting bending and wrapping without severing the conductor. Also, it is necessary to employ a composite when the graphite conductor is to be strung overhead or pulled through a conduit as for example in building wiring. As will be apparent, such composites are also useful with intercalated graphite forms other than filaments.

An especially surprising aspect of the present invention is the relative ease and effectiveness with which graphite fibers can be intercalated in accordance with the present process. The structure of high modulus graphite filaments is such that the normal to the "c" axis lies parallel to the filament axis and there is an axis of rotational symmetry about this normal. It has been determined by crystallographic analysis that interatomic spacing along the "c" axis is about 3.35 Å whereas along the "a" axis it is about 1.42 Å.

Hence, the interplanar spacing in graphite is such that interstitial diffusion can readily take place parallel to the filament axis, i.e. along the "a" axis, but with very great difficulty along the "c" axis, i.e. perpendicular to the filament axis. Thus, it would be expected that because of the crystallographic orientation in graphite filaments, interstitial diffusion would be practically excluded since diffusion has to occur along the "c" axis, or in a direction other than that in which diffusion easily takes place.

Nevertheless, it has been found that graphite filaments are readily intercalated by employing the particular reactants and process of the present invention. Although there is no theoretical explanation of this phenomenon, graphite filaments having high degrees of intercalation and markedly high conductivities are readily prepared.

The conductive compositions of this invention can be prepared simply and relatively cheaply. Briefly, they are prepared by combining a strong Bronsted acid-metal halide system, hereinafter called acid halide system, with graphite of relatively high crystallinity. The acid halide system preferably comprises the proton donor which is a Bronsted acid such as hydrogen fluoride, chloride, bromide or nitric, nitrous, sulfuric or perchloric acid and an electron acceptor metal halide which is a Lewis Acid such as boron trihalide, a tetrahalide from a Group IV metal, or a pentahalide from a Group V metal. Although not critical, the acid halide system usually comprises the Bronsted acid and one of the above Lewis acids in approximately equimolar proportions. However, the molar ratio of Lewis acid to Bronsted acid can range from about 0.01:1 to 100:1.

Since many of these materials are volatile and highly reactive care must be taken to exclude moisture and oxygen and they are best handled under a substantially moisture-free, inert atmosphere. It has been found especially practical to combine the acid halide system with the graphite under inert conditions. Typically, it is preferred to employ an apparatus such as a dry box. This apparatus permits the Bronsted acid, Lewis acid and graphite materials to be placed separately, in sealed containers, into a closed chamber which is flushed with an inert gas such as dried argon or nitrogen. Access to the chamber is provided by gas-tight gloves. Hence, the sealed containers are opened under an inert atmosphere and mixing of the acid halide system and graphite can be performed without fear of contamination.

The graphite materials to be combined with the acid halide system may be in the form of large crystals, crystalline powder, carbon, or graphite filaments, powdered carbon, bulk or sintered graphite. It is a general rule that the more perfect the graphite starting material is, the better the conductivity of the resultant intercalation compound. Hence, it is preferable to employ graphite of relatively high purity and which has a high degree of crystallinity. However, satisfactory results have been obtained with graphites with lower degrees of purity, and crystallinity. In the case of carbon filaments and powdered carbon, the material is preferably graphitized by known methods prior to combination with the acid halide system.

Formation of the graphite intercalation compound is achieved by exposing the graphite solid to the acid halide system, described supra, which is preferably in the liquid state. This will provide convenience in handling as well as efficiency of reaction. The intercalation reaction, however, can also be conducted by exposing the graphite to an acid halide system which is in the vapor phase.

Reaction times range from a few minutes to several hours, depending on whether the graphite is powdered, large crystals, filaments, etc. Optimum reaction times have been found to be 1 to 30 minutes with filaments and powders and 0.1 to 3 hours with large crystals. In general the reaction times is about 20 minutes for most intercalation compounds.

Temperatures at which the graphite, acid halide system reaction can be conducted range from about 10° C. to 200° C. The upper limit is determined by the boiling point of the acid halide system and whether the reaction is conducted in the liquid or vapor phase. It has been found that the resultant conductivity of the intercalation compound varies somewhat with the reaction temperature. For example, when the acid halide system employed is an equimolar gaseous mixture of HF and $BF_3$ and the graphite is "Thornel 75" graphite (produced by Union Carbide Corporation), treatment at room temperature will result in an average resistivity ratio of the original graphite to the intercalation compound of about 14, whereas reaction at 55° C. will produce a ratio of about 25. If a liquid phase reaction is desired and the reaction temperature is above the boiling point of the acid halide system, the reaction may be conducted at elevated pressures to ensure that the acid halide system is in the liquid phase.

Because of the corrosive nature of the acid halide system employed in this process, it is advisable that the apparatus and treatment vessels which contact the reactants be constructed of inert materials. Typical of such materials are 316-type stainless steel, "Monel" (available from the Huntington Alloy Products Division of the International Nickel Co., Inc.), "Teflon" (E. I. DuPont de Nemours & Co.), and "Kel-F" polymer 3M Company).

In another embodiment of the present invention, intercalated filaments are incorporated into a metal composite, as mentioned supra, to imbue the filaments with enhanced physical properties such as flexibility, strength against breakage, solderability, etc.; properties which are akin to metal conductors. Thus a metal composite of the intercalated filaments of the present invention has wider possibilities for practical application than the filaments themselves.

Metal/intercalated graphite composites of the present invention can be prepared from any of a number of desired metals, and the particular metal employed is restricted solely by the intended application of the composite. Copper is deemed preferable for most applications, but excellent results are obtained from silver, aluminum and nickel. It is also advantageous from a structural standpoint to utilize metals which form a hexagonal lattice structure, such as zinc and cadmium. Such metals are particularly compatible with graphite (which is also hexagonal) in that advantageous reorientation can be achieved during the deformation stage in preparing the metal composite.

Several methods can be employed in preparing metal composites of the graphite compounds of the present invention. , If the graphite is in filament form, a plating technique can be employed. Hence, intercalated filaments which have been thoroughly washed and dried are made the cathode in a metal plating solution. This process can be batchwise, in which case an electrode is attached to one end of a yarn which is submerged in the plating solution. Alternatively, the composite can be made continuously by passing the strands over a metal electrode and into the plating bath. Residence times and other reaction conditions are easily determinable by one of reasonable skill in the art, and such reaction parameters are functions of the particular plating bath, cathode current, graphite yarn conductivity, cross-sectional area, etc.

Another method of forming metal composites of graphite filaments involves twisting metal strands or wires with intercalated filaments. Hence, it is possible to greatly vary physical and electrical properties of conductors by varying the ratio of metal to graphite strands and by choosing strands of a particularly suitable metal.

Powdered intercalated graphites, on the other hand, can be formed into a composite by a different process. The powdered graphite is thoroughly mixed with a powder of the desired metal and compressed at pressures in the range of about 10 to 100,000 psig. The exact pressure, of course, depends on the specific metal employed. Using copper, it has been found that a pressure of about 60,000 psig. is ideal for copper particles having an average size of 60μ. This compression step is then followed by annealing at temperatures of about 250° to 1000° C. in a hydrogen atmosphere.

The ratio of metal to graphite in this process is not critical, but the resultant composite preferably contains as much intercalated graphite as possible. However, when the metal phase becomes discontinuous the strength of the matrix is seriously impaired. To ensure continuity of the metal phase, it has been found desirable to employ about 30% graphite by volume. This amount permits the use of a wide range of particle sizes. It should be noted that best results are obtained when fine metal particles are employed, and when an excess of 30% graphite is used the metal particles must be finer than if the graphite is restricted to 30%.

This process is adaptable to well-known powder metallurgy techniques and the resultant metal composite can readily be formed into wire or other suitable conductors.

Another way to form a metal composite, and which is especially suitable for powdered intercalated graphite, is the "sheath method". In this method, a tube of the appropriate metal, such as ¼" copper tubing, is filled with the intercalated powder. The powder is lightly tamped. Excessive packing of the powder hampers electrical orientation of the graphite and is to be avoided. When full, the tube is preferably sealed and subjected to swaging. Typically, a ¼" o.d. copper tube, filled with the graphite powder, is swaged down to a diameter of about 40 mils by means of a Torrington Swaging Mill. The resultant metal composite conductor comprises a 40 mil wire having excellent physical and electrical properties.

The following Examples are provided to further illustrate embodiments of this invention. It will be apparent that there are many more embodiments within the scope of this invention than those set forth below, and this invention is not meant as being restricted by the Examples.

EXAMPLE 1

Graphite, Boron Trifluoride, Hydrogen Fluoride Intercalation Compound

Graphite filaments were intercalated by exposing them to a gaseous mixture of $BF_3$ and HF under anhydrous conditions in an inert atmosphere. The fibers employed were Thornel 75 graphite fibers marketed by Union Carbide Corp., and were approximately 10μ in diameter. A reaction chamber less than 1 liter in volume, of 316 type stainless steel was thoroughly flushed with dry nitrogen at a rate of 1 l./min. for 30 minutes. The chamber, containing the graphite fiber, was heated to about 57° C., whereupon $BF_3$ and HF were introduced at a rate of 3.5 l/min and 3 l./min. The graphite filaments were thus exposed to the acid system for about 20 minutes, whereupon the excess gas was flushed out of the apparatus using nitrogen at a rate of 1 l./min. for about 30 minutes. The intercalated filaments were then removed from the apparatus, washed consecutively with distilled water and acetone, and dried at room temperature.

EXAMPLE 2

Graphite, Phosphorus Pentafluoride, Hydrogen Fluoride Intercalation Compound Twenty five ml of an equimolar mixture of $PF_5$ and anhydrous HF was prepared by condensation at −80° C. in a Kel-F tube. The condensed mixture was then evaporated under a nitrogen atmosphere into an adjoining reaction tube which contained about 5 g. of graphite powder (Poco Graphite, Inc.), and permitted to react at about 25° C. for about 10 minutes. The reaction tube was then flushed with nitrogen and the intercalated graphite powder was recovered.

EXAMPLE 3

Graphite, Antimony Pentafluoride, Hydrogen Fluoride Intercalation Compound

A mixture of $SbF_5$ and HF was prepared by weighing 61.5 g of $SbF_5$ into a tared Kel-F reaction tube. Graphite filaments similar to those of Example 1 were then immersed in 25 ml of the above $SbF_5$/HF mixture at room temperature for about 15 minutes. The resultant intercalated filaments were washed with distilled water, then acetone, and dried at room temperature.

EXAMPLE 4

Graphite, Silicon Tetrafluoride, Hydrogen Fluoride Intercalation Compound

An equimolar mixture of $SiF_4$ and HF is prepared by condensing $SiF_4$ into liquid HF at −80° C. 25 ml of this mixture is evaporated into a reaction chamber containing 5 grams of Poco graphite powder. The powder and gas are permitted to react at about 25° C. for 10 minutes with occasional agitation to expose fresh graphite surfaces. The excess gas is then flushed out of the tube and the intercalated powder is recovered.

EXAMPLE 5

Copper Tube Intercalated Compound Composite

A 6 inch length of ¼" o.d. copper tubing was sealed at one end and filled with graphite powder which had been intercalated with an HF/$BF_3$ mixture. The powder had an average particle size of about 40μ. The powder was lightly tamped into the tube and the open end sealed.

The filled tube was then swaged down to a terminal diameter of about 40 mils. A swaging mill manufactured by The Torington Company (Connecticut) was used. Stepwise swaging through a series of dies resulted in a 40 mil wire of about 7 ft. in length. The dies successively employed were 0.25, 0.187, 0.125, 0.110, 0.094, 0.081, 0.071, 0.063, 0.053, 0.046 and 0.040 inches.

EXAMPLE 6

Copper-Intercalated Compound Composite

A 2.1 g. sample of intercalated graphite powder similar to that used in Example 5 was mixed homogeneously with about 9.0 g copper powder having an average particle size of 60. After thorough mixing, a 1.3 g sample of the homogeneous mixture was pressed into a bar measuring ⅛ by ⅛ by 1 inch using a pressure of about 60,000 psig. The resultant density of the bar was about 4.95 g/cc. The bar was then annealed in the presence of $H_2$ at about 475° C. The composite thus formed had excellent strength and electrical conductivity and consisted of about 50% by volume of copper and 50% by volume of graphite intercalate.

EXAMPLE 7

Copper Plate Intercalated Compound Composite

A metal composite of intercalated graphite filaments was prepared by using standard electroplating techniques. A 1000 cm length of an intercalated filament of 10μ was passed over a grooved metal wheel into a copper plating bath. The metal wheel served as the cathode. The filament was continuously passed through this bath at a speed of about 10 cm/min. A current of about 0.10 amperes caused a 2μ layer of copper on the filament. About 700 of the electroplated filaments were compacted and twisted by running them through grooved rollers so as to give about 95% density to the cross section of the resultant wire. The wire, which had a diameter of about 0.38 mm was further consolidated by annealing at 475° C. under a hydrogen atmosphere.

I claim:

1. A process for preparing a conductor for transmission of electricity, which comprises reacting graphite with a Bronsted acid selected from hydrogen fluoride, hydrogen chloride, hydrogen bromide, nitric acid, nitrous acid, sulfuric acid or perchloric acid and an electron acceptor metal halide selected from a boron trihalide, a pentahalide of a Group V A or B metal, a tetrahalide of a Group IV A or B metal, or mixtures thereof wherein the molar ratio of the Bronsted acid to metal halide ranges from about 0.01:1 to about 100:1, the reaction is conducted under a substantially moisture free, inert atmosphere, at a temperature of at least about 10° C. and the Bronsted acid and metal halide or boron trihalide are in a liquid or gas phase, said reaction producing a graphite intercalation compound; and shaping said graphite intercalation compound into a form adapted for the conduction of electricity.

2. A process according to claim 1 wherein the conductor is a metal plated filamentary electrical conductor, the graphite intercalation compound is in a filament form, and shaping is accomplished by plating the filament with a metal by means of an electrolytic metal plating process.

3. A process according to claim 1 wherein the conductor is a stranded electrical conductor;

the graphite intercalation compound is in a filament form; and shaping in accomplished by twisting the filaments together with metal wires to form the stranded conductor.

4. A process according to claim 1 wherein the conductor is a composite electrical conductor;

the graphite intercalation compound is in particulate form; and shaping is accomplished by mixing the particulate compound with metal particles to form a mixture, compressing the mixture under sufficient pressure to cause the compound and metal particles to become substantially continuous phases and to have the form of a unitary structure, and annealing the unitary structure in a hydrogen atmosphere at a temperature of about 250° C. to 1000° C. to produce the composite conductor.

5. A process according to claim 1 wherein the conductor is a metal coated electrical conductor;

the graphite intercalation compound is in particulate form; and shaping is accomplished by filling a metal tube with the particulate compound, sealing the ends of the tube, and swaging the filled tube to a smaller diameter to produce the metal coated electrical conductor in the form of a wire having a substantially continuous phase of graphite intercalation compound.

6. A process for preparing a conductor for transmission of electricity which comprises reacting graphite with hydrogen fluoride and an electron acceptor metal halide selected from a boron trihalide, a pentahalide of a group V A or B metal, a tetrahalide of a Group IV A or B metal, or mixtures thereof, wherein the molar ratio of the hydrogen fluoride to metal halide ranges from about 0.01:1 to about 100:1, the reaction is conducted under a substantially moisture free, inert atmosphere, at a temperature of at least about 10° C. and the metal halide is in liquid or gas phase, said reactor producing a graphite intercalation compound; and shaping said graphite intercalation compound into a form adapted for the conduction of electricity.

7. The process in accordance with claim 6, wherein the metal halide is selected from the group consisting of $BF_3$, $SiF_4$, $HfF_4$, $TiF_4$, $ZrF_4$, $PF_5$, $NbF_5$, $TaF_5$, $AsF_5$, $SbF_5$ and mixtures thereof.

8. The process in accordance with claim 6, wherein said molar ratio is about 100:1.

9. A process according to claim 6 wherein the conductor is a metal plated filamentary electrical conductor, the graphite intercalation compound is in a filament form, and shaping is accomplished by plating the filament with a metal by means of an electrolytic metal plating process.

10. A process according to claim 6 wherein the conductor is a stranded electrical conductor;

the graphite intercalation compound is in a filament form; and shaping is accomplished by twisting the filaments together with metal wires to form the stranded conductor.

11. A process according to claim 6 wherein the conductor is a composite electrical conductor;

the graphite intercalation compound is in particulate form; and shaping is accomplished by mixing the particulate compound with metal particles to form a mixture, compressing the mixture under sufficient pressure to cause the compound and metal particles to become substantially continuous phases and to have the form of a unitary structure, and annealing the unitary structure in a hydrogen atmosphere at a temperature of about 250° C. to 1000° C. to produce the composite conductor.

12. A process according to claim 6 wherein the conductor is a metal coated electrical conductor;

the graphite intercalation compound is in particulate form; and shaping is accomplished by filling a metal tube with the particulate compound, sealing the ends of the tube, and swaging the filled tube to a smaller diameter to produce the metal coated electrical conductor in the form of a wire having a substantially continuous phase of graphite intercalation compound.

13. A process for preparing a conductor for transmission of electricity which comprises reacting graphite with an acid halide system comprised of a Bronsted acid selected from hydrogen fluoride, hydrogen chloride, hydrogen bromide, nitric acid, nitrous acid, sulfuric acid or perchloric acid; and an electron acceptor metal halide selected from boron trihalide, a pentahalide of a Group V A or B metal, a tetrahalide of a Group IV A or metal, or mixtures thereof wherein the molar ratio of the Bronsted acid to metal halide ranges from about 0.01:1 to about 100:1, the reaction is conducted under a substantially moisture free, inert atmosphere, at a temperature of at least about 10° C. and the Bronsted acid and metal halide are in a liquid or gas phase.

14. The process in accordance with claim 13 wherein said Bronsted acid is hydrogen fluoride.

15. A process for conducting electricity comprising:

providing an electrically conductive material, said material comprising:

(a) graphite;

(b) an acid halide system, said system being comprised of:

(i) a Bronsted acid selected from hydrogen fluoride, hydrogen chloride, hydrogen bromide, nitric acid, nitrous acid, sulfuric acid or perchloric acid; and (ii) an electron acceptor metal halide selected from boron trihalide, a tetrahalide of a Group IV A or B metal, a pentahalide of a Group V A or B metal, or a mixture thereof; the molar ratio of the Bronsted acid to the metal halide being from about 0.01:1 to about 100:1; and connecting said material between an electrical source and a point of electrical use.

16. The process in accordance with claim 15, wherein said Bronsted acid is hydrogen fluoride.

17. The process in accordance with claim 15, wherein the metal halide is selected from the group consisting of $BF_3$, $SiF_4$, $HfF_4$, $TiF_4$, $ZrF_4$, $PF_5$, $NbF_5$, $TaF_5$, $AsF_5$, $SbF_5$ and mixtures thereof.

* * * * *